United States Patent [19]

Hilton et al.

[11] Patent Number: 4,953,661

[45] Date of Patent: Sep. 4, 1990

[54] LADDER ATTACHMENT

[76] Inventors: Allan R. Hilton, 10 Crawford Avenue, Chorley, Lancashire, England, PR7 4DY; Phillip Mathews, 1 Mansion Street, Bramalea, Ontatio, Canada, L6S 3C9

[21] Appl. No.: 422,531

[22] Filed: Oct. 17, 1989

[51] Int. Cl.[5] ..... E06C 7/14; E06C 7/16

[52] U.S. Cl. ..... 182/120; 248/230

[58] Field of Search ..... 182/120, 121, 122; 248/238

[56] References Cited

U.S. PATENT DOCUMENTS

| | | | |
|---|---|---|---|
| 2,140,828 | 12/1938 | Carle | 182/122 |
| 2,245,661 | 6/1941 | Fieroh | 182/122 |
| 3,067,836 | 12/1962 | Carnicelli | 182/121 |
| 4,586,586 | 5/1986 | Canals | 182/122 |

*Primary Examiner*—Reinaldo P. Machado

[57] ABSTRACT

An attachment for use on a ladder to provide a step or tool support having a frame which can be supported on a ladder, and a movable structure which is pivotally mounted on the frame for movement between a retracted and extended position to provide the step.

14 Claims, 3 Drawing Sheets

FIG. 4
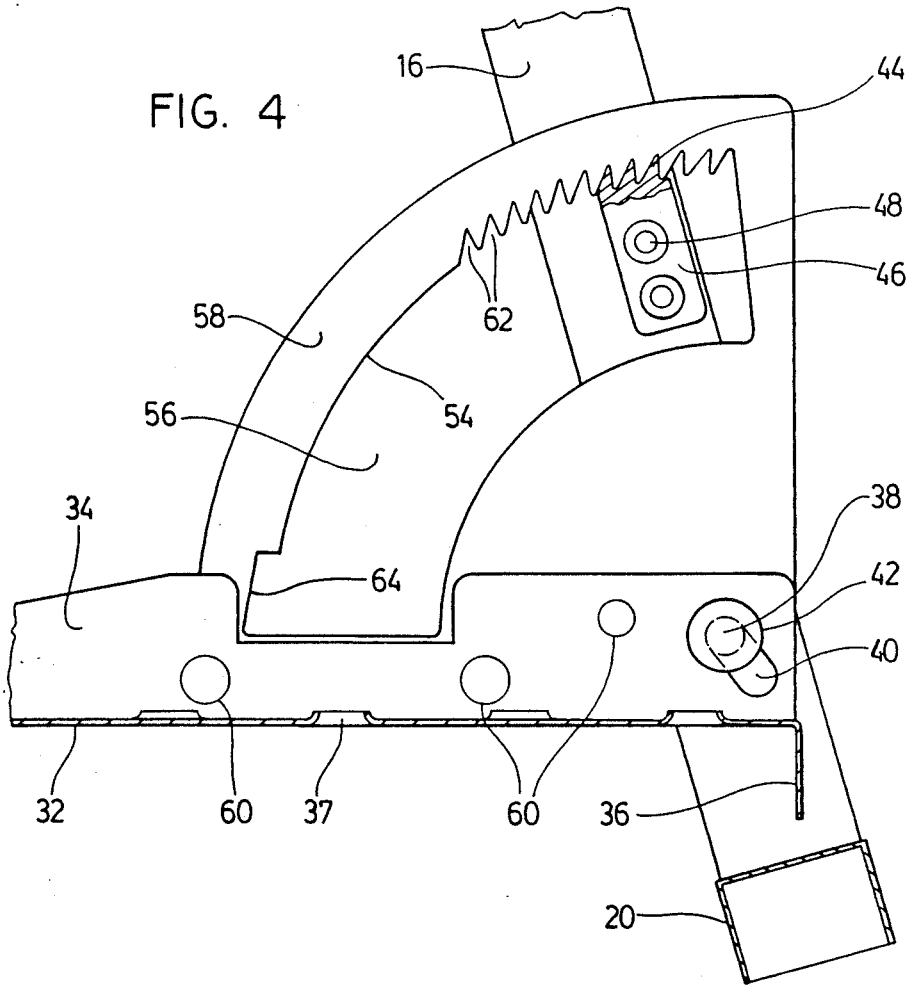
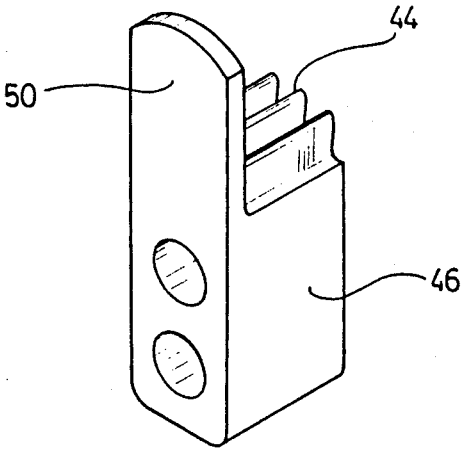
FIG. 5

LADDER ATTACHMENT

FIELD OF THE INVENTION

This invention relates to ladder attachments and more particularly to a ladder attachment which functions to provide a step or a support shelf when it is mounted on a ladder.

BACKGROUND OF THE INVENTION

Various ladder attachments have heretofore been proposed for the purpose of providing a user with a shelf or ledge on which tools or supplies such as a can of paint can be placed to free the user's hands for the task at hand.

Such known attachments could not, however, be used as a tread or step on which the user could place one or both of his feet since the security of attachment was not sufficient to support the user's weight. With other known ladder attachments, there was a danger of the attachment becoming detached from the ladder.

Accordingly, it is a principal object of this invention to provide a ladder attachment which has a sufficiently robust contruction to support a user's weight and which can be mounted on a ladder so that there is minimal risk of accidental detachment from the ladder.

Yet another object of this invention is to provide a ladder attachment meeting the foregoing principal object and yet which is of simple and relatively inexpensive construction A further important object of this invention is to provide a ladder attachment which includes a movable structure which can be used as a ledge or step, the position of which can easily be adjusted so that it is essentially horizontal regardless of the inclination of the ladder itself.

Yet another object of this invention is to provide a ladder attachment which is not easily accidentally dislodged from a ladder on which it is mounted.

Other objects of the invention will become apparent as the description herein proceeds.

SUMMARY OF THE INVENTION

Broadly, the present invention provides a ladder attachment comprising a frame adapted to be releasably attached to a ladder, and a support platform moveably mounted on the frame, and swingable between a retracted position and an extended position extending outwardly from the frame and from the ladder and providing a step or shelf.

More particularly, it is an objective of the invention to provide a ladder attachment having the foregoing advantages which can be attached to the rungs of the ladder intermediate its ends to provide a step or ledge at any point desired by the user.

More particularly, it is an objective of the invention to provide a ladder attachment having the foregoing advantages including locking means for locking the orientation of said support platform relative to said frame, where by the support platform may be set at a desired angle relative to the angle of the ladder.

In the preferred embodiment, the ladder attachment includes a pair of spaced apart side rails interconnected by a plurality of mutually spaced apart rungs and which ladder attachment comprises a frame having a major plane and defined by spaced apart side members; an upper forwardly directed and downwardly open attachment means on the frame adjacent an upper end thereof and comprising, a first upper flange adapted to project forwardly through the ladder between the side rails thereof upwardly of a first rung and a second upper flange adapted to project downwardly forwardly of such first rung whereby the ladder attachment can be supported on such first rung by lowering the upper attachment means over such first rung; a lower forwardly directed flange on the frame adjacent a lower end thereof to project forwardly through the ladder between the side rails thereof then to restrict sideways movement of said frame, a movable support structure mounted between the side members of the frame pivot means connecting between the movable structure and the side members of the frame and adapted to permit swinging movement of the movable structure between a retracted position in which the movable structure is disposed in a plane adjacent the plane of the frame and a fully extended position in which the movable structure extends forwardly through the ladder between the side rails thereof.

Said pivot means preferably comprise pivot means cooperating pivot pins and elongated pin-receiving slots on each side edge of the movable structure and each side member of said frame; a fixed member on each of the side members of said frame upwardly of said pivot means and comprising at least one upwardly projecting detent member; a ratchet member on each of the side edges of the movable structure, projecting downwardly and comprising a plurality of recesses adapted to receive said detent members so as then to retain the movable structure in a desired pivotal position relative to the frame, pivotal movement of the movable structure relative to the frame being possible only when the pivot pins are disposed at upper ends of the pin-receiving slots and such pivotal movement being prevented by engagement of the detent members in respective ones of the recesses when the pivot pins are disposed at lower ends of the pin-receiving slots.

The pivot pins provided on a ladder attachment in accordance with this invention are usefully provided so as to project inwardly from the side members of the frame, the pin-receiving slots then being provided in the side edges of the movable structure.

The movable structure of a ladder attachment in accordance with this invention will generally be planar so permitting its use as a shelf or step. Openings are then usefully provided to permit liquids to drain therefrom.

The lower forwardly directed flange on the frame preferably has a width such that it extends the entire distance between the side rails of a ladder when the attachment is supported thereon, thereby to completely restrict sideways movement of the frame relative to such ladder.

In accordance with another preferred feature of this invention, the fixed member of the ladder attachment usefully comprises a plurality of mutually spaced apart detent members with the recesses in each of the ratchet members being disposed so as simultaneously to receive all such detent members.

The various features of novelty which characterize the invention are pointed out with more particularity in the claims annexed to and forming part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

The invention will now be described merely by way of illustration with reference to the accompanying drawings, in which:

FIG. 4 is a fragmentary sectional view similar to that of FIG. 3 but showing the movable structure in an extended position thereof; and FIG. 5 is an enlarged perspective view of one component of the attachment shown in the preceding figures.

DESCRIPTION OF A PREFERRED EMBODIMENT

Figure 1:
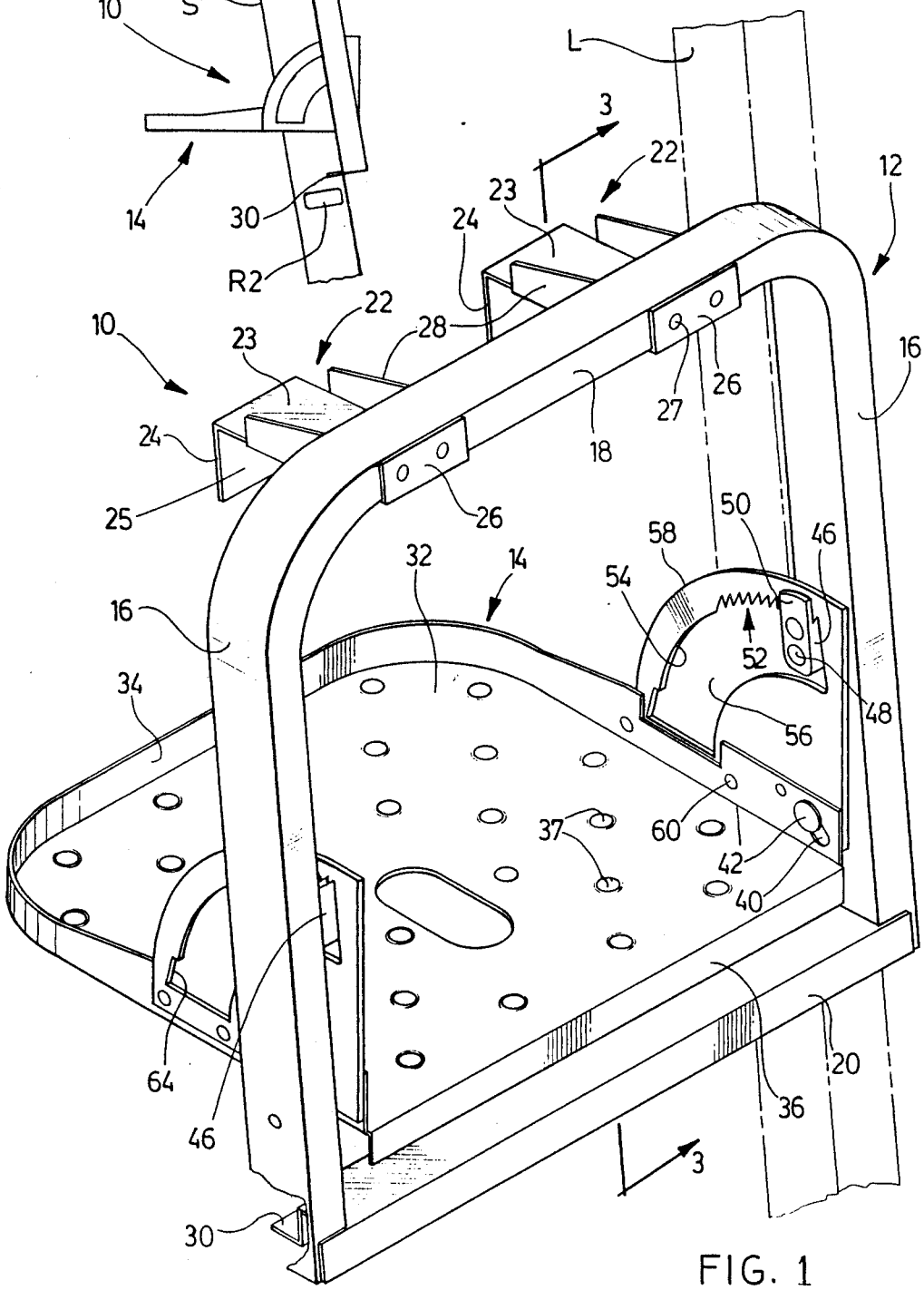
FIG. 1 is a perspective view partly cut away showing one embodiment of a ladder attachment in accordance with this invention.

Referring first to FIG. 1 of the accompanying drawings, there is indicated therein generally at 10 one embodiment of a ladder attachment in accordance with the present invention.

The attachment 10 comprises a connection frame generally indicated at 12 and a movable support structure generally indicated at 14

The frame 12 is generally planar and comprises a pair of spaced apart side members 16 connected by an integrally formed upper cross member 18 and a lower cross member 20. The members 16, 18 and 20 of the frame 12 will generally be formed from a tubular or channel material.

Figure 2:
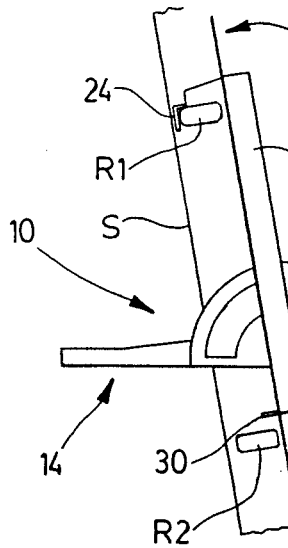
FIG. 2 is a fragmentary side elevation of a ladder with the attachment of FIG. 1 mounted thereon.

At an upper end of the frame 12 there is provided attachment means for attaching the attachment 10 to a ladder L (FIG. 2). In the particular embodiment shown in the accompanying drawings, the attachment means comprises a pair of mutually spaced and identical brackets generally indicated at 22 and secured to the upper cross member 18.

Each of the brackets 22 comprises a forwardly projecting first flange 23 which is integrally formed, at its forward end, with a downwardly dependent second flange 24. As will best be understood by reference to FIG. 3, each of the flanges 23 extends rearwardly beneath the upper cross member 18 and is integrally formed with an upwardly extending flange 26 secured to the upper mass member 18 by rivets 27. Reinforcing side flanges 28 are advantageously integrally formed with each flange 23 at each side edge thereof.

The lower cross member 20 is integrally formed along its lower edge with a forwardly directed lower flange 30 which, for a reason which will become apparent as the description herein proceeds, preferably terminates at ends which are aligned with the inner edges of respective ones of the side members 16, as will best be understood by reference to FIG. 1.

Having now described the basic structure of the connection frame 12, the manner in which the attachment 10 is mounted on a ladder L will briefly be explained. It is believed that such an explanation at this stage of the description will facilitate comprehension of the more detailed description hereinafter given of the construction of the attachment 10. Referring to FIG. 2, it will be seen that the ladder L is of conventional construction having a pluraity of mutually spaced apart rungs R extending between side rails S. It is now conventional to construct ladders with a standard inter-rung spacing of twelve inches. In FIG. 2, two adjacent rungs, namely a first or upper rung R1 and a second rung R2 immediately below the first rung R1, are shown.

To mount the attachment 10 on a ladder L, the movable structure 14 of the attachment 10 is first aligned with the space between the rungs R1 and R2. The attachment 10 is then lowered until the flanges 24 are disposed forwardly of the rung R1. That rung R1 then supportingly engages the flanges 23. The lower end of the attachment 10 is now pivoted forwardly until the flange 30 is received between the side rails S above the rung R2.

When the attachment 10 is so mounted on a ladder 10, the side members 16 of the frame 12 rest against the side rails S of the ladder. With the flange 30 in position between the side rails S, the attachment 10 cannot accidentally be swung sideways and dislodged from engagement with the rung R1.

Figure 3:
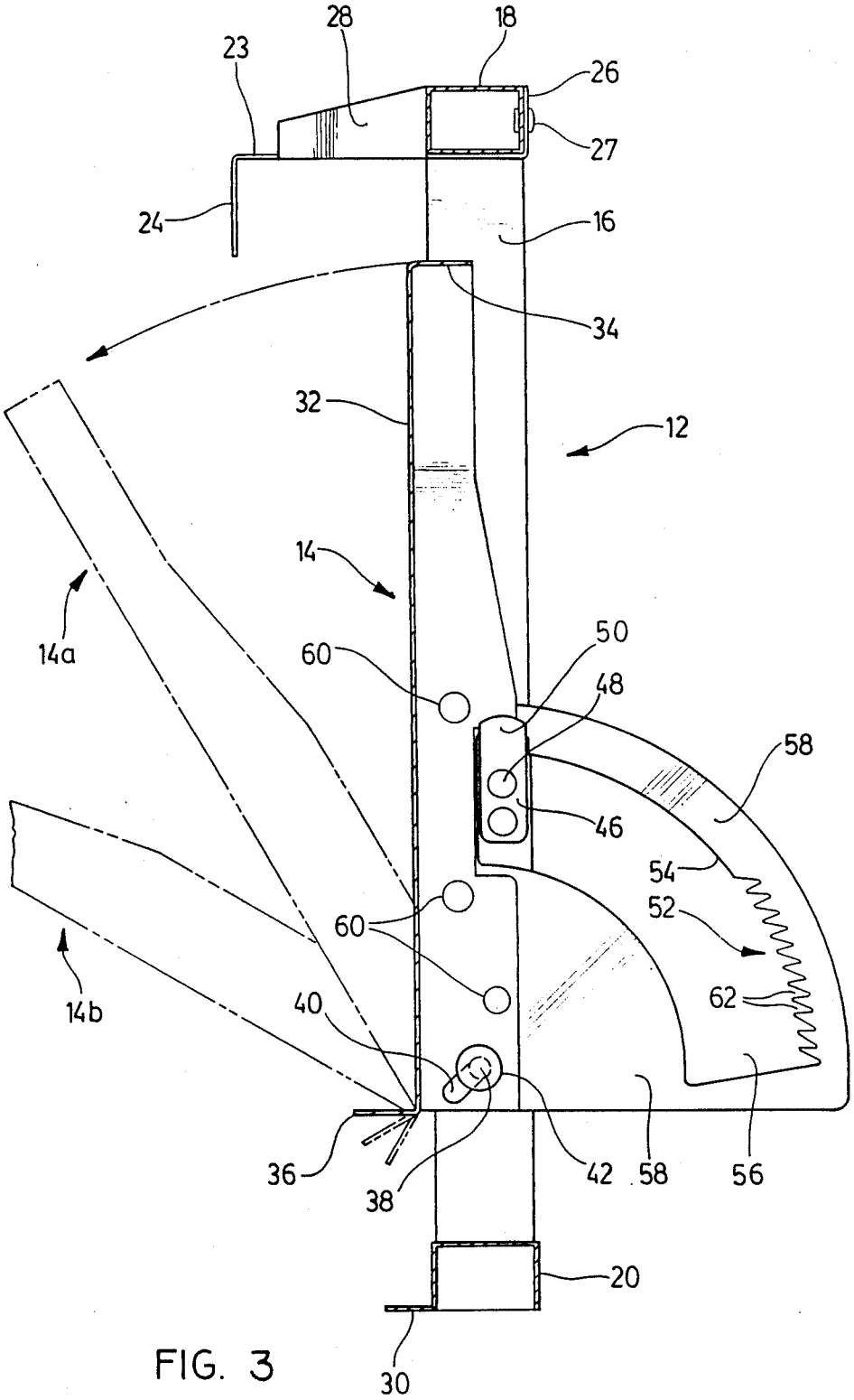
FIG. 3 is a sectional view through the attachment of FIG. 1 when taken as indicated by the arrows 3—3 of that figure and showing a movable structure of that attachment in its fully retracted position.

The movable structure 14 is mounted in a manner yet to be explained on the frame 12 for movement between a fully retracted position shown in solid lines in FIG. 3 and a fully extended position shown in FIG. 1. Various intermediate positions for the movable structure are also possible as shown in phantom outline at 14*a* and 14*b* in FIG. 3.

In the particular embodiment illustrated in the drawings, the movable support structure 14 is in the form of a generally planar member 32 integrally formed along its forward edge and both side edges with an upstanding edge flange 34. Across its rearward edge, the member 32 is integrally formed with a downwardly projecting flange 36. Openings 37 are usefully stamped through the generally planar member 32.

For pivotally mounting the movable structure 14 in the frame 12, pivot pins 38 are provided on the opposed inner surfaces of the side members 16 of the frame 12 slightly upwardly of the lower cross member 20. These pivot pins 38 extend through elongated pin-receiving slots 40 formed in the edge flange 34 of the movable structure 14. Enlarged heads 42 on the pins 38 prevent accidental disassembly of the attachment 10.

For a reason which will become apparent as the description herein proceeds, the pin-receiving slots 40 are disposed so as to extend upwardly and forwardly at an acute angle to the frame 12 when the movable structure 14 is disposed in its fully extended position (FIG. 1).

The attachment 10 also comprises ratchet and detent members for locking the movable structure in various angular positions relative to the frame 12.

In the particular embodiment illustrated, the detent members are in the form of three equally spaced apart teeth 44 formed on brackets 46 secured, for example, by rivets 48 to the side members 16 of the frame 12. For a reason yet to be explained, each of the brackets 46 is usefully formed with an upwardly projecting end tongue 50 which is spaced apart inwardly relative to the respective ones of the side members 16.

The ratchet members provided on the movable structure 14 are in the form of saw-like racks generally indicated at 52 provided on the outer edges 54 of arcuate openings 56 formed in upstanding brackets 58. The brackets 58 are secured to opposite edge flanges 34 of the planar member 32 by rivets 60. The saw-like racks 52 comprising recesses or notches 62 are disposed outwardly of respective ones of the aforementioned tongues 50 to eliminate the risk of the racks slipping inwardly off the teeth 44.

The notches 62 are equally spaced and are shaped and dimensioned so as to able simultaneously to receive all three teeth 44 of the respective bracket 46.

At its end closest to the planar member 32, the outer edge 54 of the arcuate opening in each bracket 58 is formed with a larger notch 64 for collectively receiving the respect set of all three detent teeth 44 when the movable structure 14 is in its fully retracted position as shown in solid lines in FIG. 3.

For use, the attachment 10 is mounted on a ladder L in the manner already described. When the attachment 10 is so mounted on a ladder but is not desired to be used, the movable structure 14 thereof can be moved into its fully retracted position as shown in solid lines in FIG. 3.

When it is desired to use the attachment 10 to provide a tread or shelf, the movable structure 14 is pivoted into a desired extended position. It will be understood that it will normally be desired to have the generally planar member 32 of the movable structure in a generally horizontal position. Clearly, the pivotal position of the movable structure 14 relative to the frame 12 to provide such horizontal disposition will be determined by the angular position of the ladder L.

Assuming that the movable structure 14 is in its fully retracted position and the ladder is also in position at a required inclination, the first step in adjusting the movable structure 14 is to lift it relative to the frame 12 so that the pivot pins 38 are disposed at the lower ends of the pin-receiving slots 40. In this position, the teeth 44 will be disengaged from the larger notches 64. The movable structure can now be pivoted until it is in the desired angular position. It is then allowed to move downwardly until the pivot pins 38 are disposed at the upper ends of the pin-receiving slots 40. At this time, the teeth 44 will be engaged by a respect set of three of the notches 62 in the racks 52.

Such engagement of the teeth 44 in the notches 62 then prevents any further pivotal movement of the movable structure 14 relative to the frame 12. The provision of the saw-like racks 52 permits fine positioning of the movable structure and allows it to be positioned more or less horizontally for all normal ladder inclinations.

If the attachment 10 is used to provide a step, positive support is provided to the user since, the greater the weight applied to the step, the more positive the engagement of the teeth 44 in the notches 62 and the less likelihood there is of accidental pivotal movement of that step.

During use the attachment 10 is positively supported by the upper rung R1 and cannot be swung sideways due the fact that the flange 30 extends between the side rails S of the ladder L.

Openings 37 are provided in the generally planar member 32 to prevent the collection of rainwater thereon and to allow for the drainage of any spilled liquids, such as paint, when it is used as a shelf. Their upwardly displaced edges (FIG. 4) also serve to provide an anti-slip surface.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A ladder attachment for use with a ladder having side members and a plurality of rungs, said ladder attachment being adapted to be attached to two said rungs intermediate the ends of said ladder, said ladder attachment comprising:

frame means having opposed parallel side frame members, and opposed parallel upper and lower frame cross members extending between said side members and forming a generally rectangular four-sided frame, and adapted to be releasably attached to said rungs on said ladder intermediate said ends, and defining upper and lower ends;

support means extending from side to side of said frame means between said side members, and being swingably mounted to said frame means adjacent said lower end thereof, and being swingable between a retracted position, and an extended position angled away from said frame means, and extending through said ladder between said side members and said rungs whereby to provide support means when said ladder is in use at an angle and thereby support a person working on said ladder;

downwardly open attachment means secured to said upper frame cross member, said attachment means being interengageable with a rung of said ladder by downward movement of said frame means relative to said ladder and being releasable therefrom by upward axial movement relative thereto, and, means on said frame means remote from said downwardly open attachment means for engaging said ladder and restraining lateral movement of said frame means relative to said ladder.

2. A ladder attachment is claimed in claim 1 including locking means for locking the orientation of said support means relative to said frame means whereby said support means can be set at a desired angle relative to the angle of said frame means.

3. A ladder attachment as claimed in claim 2 wherein said frame side-members are spaced apart a width greater than the length of said rungs.

4. A ladder attachment as claimed in claim 1 and in which said means for engaging said ladder and restraining said lateral movement of said frame means relative to said ladder comprises lower flange means on said lower frame member, adapted to extend between said side members of said ladder, whereby to prevent lateral movement of said frame means relative to said ladder.

5. A ladder attachment for use with a ladder which is intended, in use, to be positioned at different angles to the vertical and which includes a pair of spaced apart side rails interconnected by a plurality of mutually spaced apart rungs and which ladder attachment comprises:

a frame having a major plane and defined by spaced apart side members;

an upper forwardly directed and downwardly open attachment means on said frame adjacent an upper end thereof and comprising a first upper flange adapted to project forwardly through said ladder between said side rails thereof upwardly of a first rung and a second flange adapted to project downwardly forwardly of said first rung whereby said ladder attachment can be supported on such first rung by lowering said upper attachment means over such first rung;

lower forwardly directed flange means on said frame adjacent a lower end thereof adapted to project forwardly through said ladder between said side rails thereof then to restrict sideways movement of said frame;

a movable support structure having spaced apart sides mounted between said side members of said frame, and, pivot means connected between said movable structure and said side members of said frame and adapted to permit pivotal movement of said movable structure between a retracted position in which said movable structure is disposed in a plane adjacent said major plane of said frame and an extended position in whcih said movable structure extends forwardly through said ladder between said side rails thereof, said pivot means comprising cooperating pivot pins and elongated pin-receiving slots on said sides of said movable structure and said side members of said frame, and, positional locking means on said sides of said moveable structure and said side members of said frame whereby said moveable structure can be locked in a various angular positions relative to said frame.

6. A ladder attachment as claimed in claim 5, in which said movable member has side edges and said pivot pins project inwardly from said side members of said frame and said pin-receiving slots are provided in said sides of said movable structure.

7. A ladder attachment as claimed in claim 6 and in which said movable structure is generally planar permitting its use as a shelf or step.

8. A ladder attachment as claimed in claim 7 and in which openings are provided in said movable structure to permit liquids to drain therefrom.

9. A ladder attachment as claimed in claim 6 and which comprises two mutually spaced apart said attachment means on said frame.

10. A ladder attachment as claimed in claim 5 and in which said lower forwardly directed flange means on said frame has a width such that it extends the entire distance between the side rails of a ladder when said attachment is supported thereon, thereby to completely restrict sideways movement of said frame relative to such ladder.

11. A ladder attachment as claimed in claim 6, in which each said fixed member comprises a plurality of mutually spaced apart said detent members, and in which said recesses in each said ratchet member are disposed so as simultaneously to receive all said detent members.

12. A ladder attachment as claimed in claim 11 and in which each said ratchet member comprises a single enlarged recess dimensioned to receive all said detent members on the respective said fixed member when said movable structure is disposed in said retracted position thereof.

13. A ladder attachment as claimed in claim 12 and in which each said fixed member comprises an upwardly projecting tongue defining with the respective side member of said frame an upwardly open U-spaced slot moveably receiving a respective one of said ratchet members with said detent members disposed at the base of said slot.

14. A ladder attachment as claimed in claim 5 and including a fixed member on each of said side members of said frame upwardly of said pivot means and comprising at least one upwardly projecting detent member;

a ratchet member on each of said sides of said movable structure, projecting downwardly and comprising a plurality of recesses adapted to receive respective ones of said detent members so as then to retain said movable structure in a desired angular position relative to said frame, pivotal movement of said movable structure relative to said fixed frame being possible only when said pivot pins are disposed at upper ends of said pin-receiving slots and such pivotal movement being prevented by engagement of said detent members in respective ones of said recesses when said pivot pins are disposed at lower ends of said pin-receiving slots.

* * * * *